US008344195B2

(12) United States Patent
Srinakruang

(10) Patent No.: US 8,344,195 B2
(45) Date of Patent: Jan. 1, 2013

(54) PROCESS FOR PRODUCING FUEL FROM PLASTIC WASTE MATERIAL BY USING DOLOMITE CATALYST

(76) Inventor: Jumluck Srinakruang, Bangkok (TH)

( * ) Notice: Subject to any disclaimer, the term of this patent is extended or adjusted under 35 U.S.C. 154(b) by 425 days.

(21) Appl. No.: 12/580,824

(22) Filed: Oct. 16, 2009

(65) Prior Publication Data

US 2011/0089081 A1 Apr. 21, 2011

(51) Int. Cl.
*C07C 4/06* (2006.01)

(52) U.S. Cl. ..... 585/241; 201/2.5; 201/25; 202/96; 202/118

(58) Field of Classification Search ..... 585/241; 201/2.5, 25; 202/96, 118
See application file for complete search history.

(56) References Cited

U.S. PATENT DOCUMENTS 4,251,500 A * 2/1981 Morita et al. ..... 423/449.7
4,303,477 A * 12/1981 Schmidt et al. ..... 588/318
4,515,659 A * 5/1985 Wingfield et al. ..... 201/2.5
4,678,860 A 7/1987 Kuester
5,208,404 A * 5/1993 Lu ..... 585/241
5,264,640 A * 11/1993 Platz ..... 585/241
5,389,691 A * 2/1995 Cha et al. ..... 521/41
5,414,169 A * 5/1995 Takahashi et al. ..... 585/241
5,744,668 A * 4/1998 Zhou et al. ..... 585/241
5,811,606 A 9/1998 Yang
6,883,442 B1 4/2005 Groszek et al.
2009/0020456 A1 1/2009 Tsangaris et al.
2010/0228062 A1 9/2010 Babicki et al.

OTHER PUBLICATIONS

Aznar et al., "Plastic waste elimination by co-gasification with coal and biomass in fluidized bed with air in pilot plant", Fuel Processing Technology [online], May 2006 (Retrieved on Feb. 17, 2011), vol. 87, Iss. 5, pp. 409-420, retrieved from the Internet: <URL:http://www.aseanenvironment.info/Abstract/41012664.pdf>.
International Search Report dated Mar. 15, 2011 in corresponding International Application No. PCT/IB2010/02830.

* cited by examiner

*Primary Examiner* — Nina Bhat
(74) *Attorney, Agent, or Firm* — Sughrue Mion, PLLC

(57) ABSTRACT

A process for producing fuel by cracking a plastics-derived liquid, which is obtained from a pyrolysis process, using a dolomite catalyst. The plastics-derived liquid is produced by the pyrolysis of plastic waste, such as of one or more of polyethylene, polystyrene or polypropylene. The plastic-derived liquid is first subjected to a semi-batch catalytic cracking reaction over a very low cost dolomite catalyst to obtain high quality oil for fuel, which comprises mainly light and heavy naphtha. Moreover, the catalytic cracking reaction is conducted at operating temperatures lower than 320° C.

14 Claims, No Drawings

PROCESS FOR PRODUCING FUEL FROM PLASTIC WASTE MATERIAL BY USING DOLOMITE CATALYST

BACKGROUND OF THE INVENTION

1. Field of the Invention

The present invention relates to a process for producing naphtha and gas oil by a catalytic cracking of a plastics-derived liquid, which is obtained from a pyrolysis process, using a very low cost catalyst under low temperature and pressure conditions.

2. Description of the Related Art

The total amount of plastic waste is increasing every year. However, most plastics cannot rapidly degrade in a landfill and thus, become a major waste in garbage. Moreover, it is not environmentally friendly to dispose plastic waste by incineration, which leads to carbon dioxide and other greenhouse gas emissions even though incineration can generate energy. Moreover, incineration of plastics still has some drawbacks, such as high capital and maintenance cost. An alternative process to decompose plastic waste to generate energy and useful gaseous products is gasification. However, a conventional gasification process releases tars, heavy metals, halogens and alkaline compounds etc., and causes environmental problems. Another effort to utilize plastic waste, which seems to be promising, is the pyrolysis of plastic waste, resulting in a mixture of hydrocarbons of heavy oils and olefins.

Some of the present inventors previously proposed an environmentally acceptable process for disposing of scrap plastic material that contains inorganic matter in admixture with a comminuted aluminosilicate containing material to produce a synthesis gas, reducing gas, or fuel oil (U.S. Pat. No. 5,656,042). US Patent Publication No. 2007/0173673 discloses a method for catalytically cracking plastic waste and an apparatus for catalytically cracking plastic waste by using a granular FCC catalyst. International Application No. PCT/IN2004/000366 discloses a process for preparing a catalyst containing faujasite zeolite, pseudoboehmite alumina, polyammonium silicate, kaolin clay for catalytic cracking of plastic waste. Furthermore, US Patent Publication No. 2003/0019789 proposes development of a method of converting plastic waste material into gasoline, kerosene and diesel oil fraction. EP 0 535 253 describes a process for producing fuel oil and gas by cracking rubber and plastic waste at a low temperature of about 280° C. EP 0 535 253 discloses gas products which are further filtered, condensed and fractioned into light oil, heavy oil and gas. Moreover, it discloses a catalyst that is composed of 20% by wt. of CaO, 50% by wt. of Ni, 30% by wt. of XT-10, where XT-10 is a mixture of one or more of dolomite, garbbro, microcline, muscovite, tourmaline, talc, limestone etc. or China clay.

A similar process using laterite in the presence of dolomite ore is disclosed in U.S. Pat. No. 4,224,140, where catalytic cracking of a heavy oil by using laterite or a laterite-containing catalyst produces cracked distillate and a hydrogen-rich gas. U.S. Pat. No. 4,298,460 discloses a process for processing sulfur containing a heavy oil, which includes catalytically cracking the sulfur-containing heavy oil to produce a cracked distillate and hydrogen. U.S. Pat. No. 4,325,812 discloses a process for cracking heavy hydrocarbon into light oils and producing hydrogen by using a catalyst containing at least 30 wt. % of Fe in the presence of dolomite ore. However, none of these methods is efficient and is associated with high cost. And, prior to the present invention, none of the methods used dolomite itself as catalytic cracking catalyst for cracking heavy oil from plastic waste into light and heavy naphtha.

The present inventors discovered that dolomite by itself is capable of acting as the main catalyst if it is calcined at temperatures over 900° C. before it is used in the reaction.

SUMMARY OF THE INVENTION

A primary object of this invention is to provide a process for producing high quality oil for fuel which comprises mainly light and heavy naphtha by using a very low cost dolomite ore catalyst at operating temperatures lower than 320° C.

Another object of the present invention is to provide a process for disposing a large amount of plastic waste by using an environment friendly process at low operating temperatures. For example, it is very hard to decompose polyethylene at temperatures below 450° C. and large amounts of decomposed residuals are generated. However, the technology of the present invention can solve the foregoing problem and provide high reaction efficiency to decompose polyethylene, a linear chain molecule that is difficult to decompose, at temperatures lower than 400° C.

Thus, the present invention relates to a process for producing fuel from plastic waste material by using a dolomite catalyst comprising: (a) performing pyrolysis of said plastic waste material to produce a liquid material for cracking, and (b) mixing said liquid material with a dolomite catalyst which was prepared by calcining natural ore dolomite at a temperature of 900° C. or above, and cracking said liquid material at a temperature from about 300° C. to about 500° C. in a reactor while mixing, so that said liquid material in contact with the dolomite catalyst is decomposed and gasified.

DETAILED DESCRIPTION OF THE INVENTION

The principle characteristic of the present invention is to use a calcined dolomite catalyst for catalytic cracking of a plastic waste liquid that is derived from a pyrolysis process to produce a high quality oil for fuel, which comprises mainly light and heavy naphtha and gas oil.

In the present invention, the dolomite catalyst is prepared by heat treating or calcining a natural ore dolomite at a temperature of 900° C. or above. The duration of the heat treatment is preferably from 2 hours to about 12 hours, more preferably from about 4 hours to about 6 hours. The heat treatment or calcination exceeding 6 hours is not harmful to the cracking reaction. However, a longer calcination time leads to high energy consumption. Suitable temperatures for calcination can range from about 900° C. to about 1,200° C., preferably from about 900° C. to 1,000° C. Increasing the calcination temperature above 1,000° C. does not influence the efficiency of catalytic activity. Calcination of natural ore dolomite may be performed under air or nitrogen gas condition.

It is to be understood that when dolomite is calcined at a temperature above 500° C., $MgCO_3$ contained in dolomite decomposes to MgO, and at a temperature above 800° C., $CaCO_3$ contained in dolomite decomposes to CaO. Therefore, the dolomite catalyst in the present invention is in an oxidized state. However, the inventors found that the dolomite will be active in the process of the present invention if it is calcined at a temperature of 900° C. or above before it is used in the reaction.

The dolomite catalyst with a particle size (average diameter) of 10~100 μm is preferable. More preferably, a catalyst having a diameter of about 10 μm is used in order to minimize the resistance to mass transfer between the catalyst and the plastics-derived liquid and able to achieve a high efficiency of catalytic cracking in a short contact time. The chemical composition of this ore-dolomite ($CaMg(CO_3)_2$) is mainly based on $MgCO_3 \geqq 41\%$, $CaCO_3 \geqq 58\%$, and Si, Al, Fe and Sr are contained in a small quantity.

In the present invention, as a first step, pyrolysis of plastic waste is conducted. The plastic waste to which the present invention is applicable are polyethylene, polypropylene, and polystyrene. The pyrolysis process may be conducted on one type of the above mentioned plastic waste material or on a mixture of two or more of the plastic waste materials. Among the types of plastic waste, the catalytic cracking of polystyrene, which mostly contains eight carbon atoms, is preferred because it easily decomposes at low temperatures and a large amount of naphtha yield in the range of 70-97% is obtained. This is due to the fact that polystyrene is composed of an aromatic hydrocarbon, which is easily removed from carbon chains. Although polyethylene is very hard to decompose at temperatures lower than 450° C., when mixed plastics are used, the yield of cracked oil is not much lower as compared with when only polystyrene is used as a raw material. Therefore, dolomite is very effective in the catalytic cracking of mixed plastic waste for obtaining high quality cracked oil.

Plastic waste, which is subject to pyrolysis, may be shredded or fragmented to the size of 5×15 mm in order to increase the catalytic cracking efficiency. It is preferable to use plastic waste in small pieces. On the other hand, large pieces of plastic waste can be used, but is not preferable because of the longer time for decomposition by pyrolysis.

In the first step, a plastics-derived liquid material for cracking is prepared by the pyrolysis of plastic waste mentioned above. A stainless steel reactor can be used for the pyrolysis. The temperature and time duration of the pyrolysis process may depend on the type of the waste. In the case of a mixture of polyethylene, polystyrene, and polypropylene, it may be desirable to conduct pyrolysis at a temperature of 375~450° C. for a duration of from about 1 hour to about 4 hours, preferably about 1~3 hours for this kind of mixture. Generally speaking, 1 to 3 hours is enough time for pyrolysis, because most of the plastic waste is thermally cracked into heavy oil. In contrast, it was found that the pyrolysis of polyethylene alone cannot be decomposed to heavy oil at temperatures lower than 450° C., and becomes residually decomposed because it is composed of a linear chain. However, by using the dolomite catalyst, it is possible to crack polyethylene at temperatures lower than 440° C., even at 370° C., and to achieve a high yield of naphtha.

The pyrolysis should be conducted under a normal pressure because plastic waste is easily carbonized and hardly evaporated at elevated pressures.

The plastics-derived liquid, which means the liquid material resulting from the pyrolysis, is obtained as a residual oil having a heavy oil content of 80 to 95% by wt. The yield of this residual oil is about 70 to 99% by wt. The yield of the residual oil increases with increasing pyrolysis time. This residual oil is used as the liquid material for cracking.

As a second step, the plastics-derived liquid obtained in the first step (pyrolysis process) is blended with calcined dolomite, and the mixture is heated at a temperature from about 300° C. to about 500° C. in a slurry reactor with high shear mixing. The blending may be done in a stainless steel slurry reactor at an elevated temperature with high shear mixing, both to improve the ease of mixing and the uniformity of the dispersion of the solid material in the plastics-derived liquid. Suitable temperatures may range from about 300° C. to about 500° C., preferably from about 330° C. to about 450° C., more preferably 380 to 420° C. The high shear mixing can be obtained by using conventional high-shear mixing equipment known in the art. Reactions are carried out with a mixing ratio of mass of catalyst (g)/mass of heavy oil (g) being 0.15:1 to 2:1. The preferable ratio of catalyst/heavy oil is about 1:1. When a ratio of dolomite/heavy oil is lower than 0.15, the heavy oil is not able to contact the dolomite very well, resulting in a lower cracked oil yield and naphtha yield, which is not desirable. In contrast, when the ratio of dolomite catalyst/heavy oil exceeds 2, problems of operation may occur. Thus, it is effective to use a ratio of mass catalyst/mass of subjected liquid higher than 0.15 and not over 2.

Yield of cracked oil in the above reaction increases as the reaction temperature increases. In case of the catalytic cracking of only polystyrene, at temperatures between 300-340° C., naphtha yield is more than 90%. However, at a high temperature, for example, temperatures higher than 350° C., this tendency is conspicuous and a large amount of residual material is obtained, which is not desirable. This may be due to the fact that polystyrene contains aromatic compounds and decomposes at a low temperature. Thus, catalytic cracking of polystyrene alone should be conducted at a low temperature. Moreover, it is economically preferred because of the low energy consumption.

The duration of heat treatment in the second step can also vary. When the heavy oil is heated together with the solid catalyst, it is preferred that the heat treatment lasts from about 30 minutes to about 5 hours, preferably 1 to 3 hours. The liquid cracked oil yield does not differ at reaction times between 3 to 5 hours. It is possible that after 3 hours from the start of the heat treatment, the reaction may reach equilibrium.

The reaction is normally conducted for 1 to 3 hours under ambient pressure. After that, the agitation is turned off, while the $N_2$ gas or another inert gas is flowed for about another hour. This gas flow may be at 10 to 50 ml/min to remove the remaining products. Preferably, $N_2$ gas is used at 15 ml/min flow for this process. The gas products exiting the reactor are further cooled with a condenser system. They are then fractioned into liquid and gas. The liquid fraction is collected in a liquid flask while the gas fraction is collected in a gas sampling port.

When the dolomite catalyst is used for cracking plastic waste into fraction oil, plastics will be decomposed by an ion reaction. Dolomite catalyst is effective for cracking coal tar or biomass tar, a complex mixture with aromatic and aliphatic compounds which are very hard to decompose, to gaseous products, for example CO, $CO_2$, $CH_4$, at temperatures over 800° C. in a gasification process. Like coal or biomass tar, plastic waste is composed of polymers, which are clusters of aromatics and hydroaromatics being interconnected with aliphatic and ether bridges. In addition, the majority of plastic waste polymers are composed of carbon hydrogen alone or with oxygen, nitrogen, or sulfur in the skeleton, the as coal and biomass. Thus, it was discovered that the catalytic cracking of the subjected liquid material obtained from pyrolysis of plastic waste is substantially similar to the catalytic cracking of tar by using a dolomite catalyst.

The present invention provides a method for catalytic cracking of plastics-derived liquid discussed above, in which cracked gases are generated by a thermal cracking reaction occurring first, followed by catalytic cracking by using a dolomite catalyst. The plastic waste which are long chain or cross-linked hydrocarbon molecules are converted into lighter hydrocarbons by thermal cracking. At the same time, by catalytic cracking with the dolomite catalyst, which improves cracking and isomerisation, a lighter hydrocarbon is cracked into naphtha.

The liquid products from the reaction in the second step may be analyzed by distillation gas chromatrography (GC) according to ASTM D 2887 wherein the relation of GC retention time to boiling point is calibrated by a standard n-paraffin mixture and the fractions of naphtha(<200° C.) and gas oil (>200° C.) are determined.

The gaseous compounds may be analyzed with FID GC for gas product carbon number of 1 to 4, and that with TCD for CO and $CO_2$. The amount of coke is accumulated on the catalyst after each experiment. The spent catalyst is weighed using a microbalance. It is then heated to a temperature of 600° C. in a furnace for 6 hours. The spent catalyst is then re-weighed. The difference in the weight of the spent catalyst before and after burning is termed as the weight of coke that is burned off.

The above described reactions are advantageously conducted at temperatures lower than 400° C. However, from the viewpoint of coke deposition on the catalyst, it increases with decreasing temperatures lower than 420° C. Thus it was found that the dolomite catalyst has very high resistance to carbon deposition at reaction temperatures over 420° C. This may be due to the fact that dolomite contains MgO which is alkaline and has high resistance to carbon deposition.

As discussed above, the process of this invention can achieve high efficient catalytic cracking of plastics-derived liquid from resulting from a pyrolysis process to obtain high quality oil for fuel, which comprises mainly light and heavy naphtha, by using a very low cost catalyst.

EXAMPLES

The present invention will be described in more detail by reference to the following examples. The present invention shall not be construed to be limited to these examples. In each example, the compositions of the dolomite catalyst used are shown in the following Table 1.

TABLE 1

Chemical analysis of dolomite compositions (% by weight)

| | |
|---|---|
| $MgCO_3$ | ≧41% |
| $CaCO_3$ | ≧58% |
| SiO | 0.258% |
| $Al_2O_3$ | 0.126% |
| $Fe_2O_3$ | 0.133% |
| SrO | 0.018% |

Example 1

In this example, yields of residual oil obtained from pyrolysis of polystyrene was compared. 60 g of polystyrene was cleaned, shredded and cut into pieces 50 to 100 mm and heated in a 600 ml 316 stainless steel pyrolysis reactor. The reactor was heated to a temperature of 375° C. Duration of the pyrolysis ranged from 1 hour to 4 hours to obtain a residual oil. The residual oil yield was in the range of 70 to 99.9% by wt. of the initial weight of the plastic used. The results are shown in Table 2.

TABLE 2

Yields of the residual oil (% by weight) at 375° C.

| Duration of heat-treatment | Run1 | Run2 | Run3 | Run4 | Run5 | Run6 |
|---|---|---|---|---|---|---|
| 1 hour | 84.7 | 88.8 | 86.7 | 81.7 | 78.3 | 70 |
| 3 hours | 99.8 | 99.9 | 99.9 | 86.7 | 99.9 | 99.9 |
| 4 hours | 99.9 | 99.9 | | | | |

Example 2

In this example, yields of cracked oil product by catalytic cracking of a plastics-derived liquid obtained from a pyrolysis process were compared at various temperatures. Residual oil obtained from Example 1, which was heated at a temperature of 375° C. for 3 hours, was then used as a raw material. The catalyst used in each experiment was prepared by calcining 400 g of the natural ore dolomite at a temperature of 900° C. for 6 hours. After being calcined, 20 g of calcined dolomite was put in a stainless steel slurry reactor, blending it with 20 g of residual oil from the pyrolysis process. The reactor was heated to the reaction temperatures shown in Table 3. Catalytic cracking of the residual oil was compared at various temperatures ranging from 300 to 500° C. The reaction was conducted for 3 hours under ambient pressure, after which the agitation was turned off, while the $N_2$ was flowed for another hour at 15 ml/min to remove the remaining products. The gas products exiting the reactor were further cooled with a condenser system. They were then fractioned into liquid and gas. The liquid oil yields obtained were in the range of 26.1 to 65% by wt. of the starting material used. The results are shown in Table 3.

TABLE 3

| Yields of the liquid cracked oil product (% by weight from pyrolysis plastics-derived liquid 3 hours at 375° C. at various catalytic reaction temperatures. | |
|---|---|
| Temperature(° C.) | Yield of liquid cracked oil product (wt. %) |
| 300 | 26.1 |
| 310 | 40.7 |
| 320 | 48 |
| 330 | 47.6 |
| 340 | 51.2 |
| 350 | 56.4 |
| 360 | 55.1 |
| 370 | 52.6 |
| 380 | 55.3 |
| 400 | 65.5 |
| 420 | 57.3 |
| 450 | 54.2 |
| 500 | 59.6 |

Example 3

In this example, yields of cracked oil product by catalytic cracking of plastics-derived liquid from the pyrolysis process were compared at various temperatures. Residual oil obtained from Example 1, which was heated at 375° C. for 1 hour, and was then used as a raw material. The catalyst used in this Example 3 was prepared in the same proportions and in the same manner as in Example 2. The catalytic cracking reaction procedure of Example 3 was the same as in Example 2. The reaction was conducted for 3 hours. The liquid oil yields obtained were in the range of 10.4 to 60.8% by wt. of the starting material used. The results are shown in Table 4.

TABLE 4

| Yields of the liquid cracked oil product (% by weight) from pyrolysis plastics-derived liquid 1 hour at 375° C. at various catalytic reaction temperatures. | |
|---|---|
| Temperature(° C.) | Yield of liquid cracked oil product (wt. %) |
| 300 | 10.4 |
| 370 | 46.4 |
| 420 | 59.1 |
| 450 | 60.8 |
| 500 | 60.0 |

Example 4

In this example, yields of cracked oil product by catalytic cracking of plastics-derived liquid from the pyrolysis process were compared at various reaction times. Residual oil obtained from Example 1, which was heated at 375° C. for 3 hours, and was then used as a raw material. The catalyst used in this Example 4 was prepared in the same proportions and in the same manner as in Example 2. The catalytic cracking reaction procedure of Example 4 was the same as in Example 2, except the temperature was set at 420° C. and the reaction time was in the range of 1 to 5 hours. The obtained liquid oil yields were in the range of 53.5 to 57.4% by wt. of the starting material used. The results are shown in Table 5.

TABLE 5

| Yields of the liquid cracked oil product(% by weight) from pyrolysis plastics-derived liquid 3 hours at 375° C. at various catalytic reaction times. | | |
|---|---|---|
| Temperature(° C.) | Reaction Time (hour) | Yield (wt. %) |
| 420 | 1 | 53.5 |
| 420 | 3 | 57.3 |
| 420 | 5 | 57.4 |

Example 5

In this example, yields of cracked oil product by catalytic cracking of plastics-derived liquid from the pyrolysis process were compared at various reaction times. Residual oil obtained from Example 1, which was heated at 375° C. for 1 hour, and was then used as a raw material. The catalyst used in this Example 5 was prepared in the same proportions and in the same manner as in Example 2. The catalytic cracking reaction procedure of Example 5 was the same as in Example 2, except the reaction time was in the range of 1 to 5 hours. The cracking was carried out at a temperature of 420° C. The liquid oil yields obtained were in the range of 59.1 to 60.1 wt. % of the starting material used. The results are shown in Table 6.

TABLE 6

| Yields of the liquid cracked oil product (% by weight) from pyrolysis plastics-derived liquid 1 hour at 375° C. at various catalytic reaction times and temperatures. | | |
|---|---|---|
| Temperature (° C.) | Reaction Time (hour) | Yield (wt. %) |
| 420 | 1 | 60.0 |
| 420 | 3 | 59.1 |
| 420 | 5 | 60.1 |

Example 6

In this example, yields of cracked oil product by catalytic cracking of plastics-derived liquid from the pyrolysis process were compared at various pyrolysis times. Residual oil obtained from Example 1, which was heated at 375° C., and was then used as a raw material. The catalyst used in Example 6 was prepared in the same proportions and in the same manner as in Example 2. Catalytic cracking of residual oil was compared at various temperatures ranging from 300 to 450° C. and various pyrolysis times in the range of 1 to 3 hour. The catalytic cracking reaction procedure of Example 6 was the same as in Example 2. The obtained liquid oil yields were in the range of 10.4 to 60.8 wt. % of the starting material used. The results are shown in Table 7.

TABLE 7

| Yields of the liquid cracked oil product(% by weight) from pyrolysis plastics-derived liquid 1 hour and 3 hours at 375° C. Catalytic cracking reaction time 3 hours. | | |
|---|---|---|
| Catalytic cracking Temperature(° C.) | Pyrolysis Time (hour) | Yield (wt. %) |
| 300 | 1 | 10.4 |
| 300 | 3 | 26.1 |
| 420 | 1 | 59.1 |
| 420 | 3 | 57.3 |
| 450 | 1 | 60.8 |
| 450 | 3 | 60.0 |

Example 7

In this example, yields of cracked oil product by catalytic cracking of plastics-derived liquid from the pyrolysis process were compared at various calcination times. Residual oil obtained from Example 1, which was heated at 375° C. for 3 hours, was then used as a raw material. The catalyst used in each experiment was prepared by 400 g of the natural ore dolomite calcined at 900° C. for 2 to 12 hours. The catalytic cracking reaction procedure of Example 7 was the same as in Example 2, except the operating reaction temperature was 350° C. for 3 hours. The liquid oil yields obtained were in the range of 43.6 to 57.5 wt. % of the starting material used. The results are shown in Table 8.

TABLE 8

| Yields of the liquid cracked oil product(% by weight) from pyrolysis plastics-derived liquid 3 hours at 375° C. Catalytic cracking reaction time 3 hours at 350° C. | |
|---|---|
| Calcination Time (hour) | Yield (wt. %) |
| 2 | 43.6 |
| 4 | 51.7 |
| 6 | 56.4 |
| 12 | 57.5 |

Example 8

In this example, yields of cracked oil product by catalytic cracking of plastics-derived liquid from the pyrolysis process were compared at various calcination temperatures. Residual oil obtained in Example 1, which was heated at 375° C. for 3 hours, was then used a raw material. 400 g of the natural ore dolomite was used in making the catalyst. In each experiment, dolomite was calcined at various calcination temperatures in the temperature range of 900° to 1,200° C. for 6 hours. The catalytic cracking reaction procedure of Example 8 was the same as in Example 2, except the operating reaction temperature was at 340° C. for 3 hours. The liquid oil yield obtained was in the range of 43.6-57.5 wt. % of the starting material used. The results are shown in Table 9.

TABLE 9

| Yields of the liquid cracked oil product(% by weight) from pyrolysis plastics-derived liquid 3 hours at 375° C. Catalytic cracking reaction time 3 hours at 340° C. | |
|---|---|
| Calcination Temperature (° C.) | Yield (wt. %) |
| 900 | 51.2 |
| 1,000 | 51.4 |
| 1,200 | 52.5 |

Example 9

In this example, coke deposition on the catalyst was compared at various temperatures and reaction times. Residual oil obtained from Example 1, which was heated at 375° C. for 1 hour, was used as a raw material. The catalyst used in Example 9 was prepared in the same proportions and in the same manner as in Example 2. The catalytic cracking reaction procedure of Example 9 was the same as in Example 2. The cracking was carried out at a temperature rang of 300 to 450° C. The reaction was conducted in the range of 1 to 3 hours. The amount of coke deposited on the catalyst after each experiment was examined. The spent catalyst was weighed by using a microbalance. It was then heated to 600° C. in a furnace for 6 hours. The spent catalyst was then re-weighed. The difference in the weight of the spent catalyst before and after burning is termed as the weight of coke that is burned off. The results are shown in Table 10.

TABLE 10

| % by weight of coke deposition on the catalyst. | | |
|---|---|---|
| Temperature(° C.) | Reaction Time (hour) | Coke (wt. %) |
| 300 | 1 | 37.1 |
| 350 | 1 | 23.0 |
| 420 | 1 | 3.7 |
| 450 | 1 | 2.6 |
| 300 | 3 | 37.5 |
| 420 | 3 | 6.8 |

Example 10

Distillation gas chromatography according to ASTM D 2887 was conducted to the liquid products obtained in Example 2. From the GC, the fractions of naphtha and gas oil were determined. The results are shown in Table 11.

TABLE 11

| Fractions (wt. %) of liquid products. Example 2 | | | | | |
|---|---|---|---|---|---|
| Temperature | Light Naptha (100° C.) | Heavy Naptha (100-200° C.) | Kerosine (200-250° C.) | Gas oil (250-350° C.) | Residual Oil (>350° C.) |
| 300 | 16.0 | 78.7 | 2.2 | 2.5 | — |
| 310 | 16.8 | 77.8 | 2.1 | 2.6 | — |
| 320 | 12.4 | 75.6 | 3.3 | 7.9 | 0.3 |
| 330 | 24.5 | 67.1 | 0.8 | 2.0 | 5.1 |
| 350 | 19.0 | 65.7 | 0.3 | 2.8 | 11.1 |
| 360 | 17.4 | 63.3 | 2.1 | 4.6 | 11.5 |
| 370 | 14.5 | 65.0 | 1.5 | 5.9 | 11.9 |
| 380 | 11.5 | 59.7 | 2.2 | 6.2 | 17.1 |

Example 11

In this example, yields of cracked oil product by catalytic cracking of plastics-derived liquid from the pyrolysis process were compared at different ratios of mass catalyst/mass of heavy oil. Residual oil obtained from Example 1, which was heated at 375° C. for 3 hours, was then used as a raw material. The catalyst used in Example 11 was prepared in the same proportions and in the same manner as in Example 2. The catalytic cracking reaction procedure of Example 11 was the same as in Example 2, except reaction temperature was set at 370° C. for 1 hour and the ratios of mass catalyst/mass of heavy oil was in the range of 0.25 to 1. The obtained liquid oil yields were in the range of 42.4 to 60.5% by wt. of the starting material used. The results are shown in Table 12.

TABLE 12

| Yields of the liquid cracked oil product(% by weight) from pyrolysis plastics-derived liquid 3 hours at 375° C. at different ratios of mass catalyst/mass of heavy oil. | | |
|---|---|---|
| Temperature(° C.) | Ratio | Yield (wt. %) |
| 370 | 1:1 | 53.2 |
| 370 | 0.75:1 | 60.5 |
| 370 | 0.25:1 | 42.4 |

Example 12

Distillation gas chromatography according to ASTM D 2887 was conducted to the liquid products obtained in Example 11. From the GC, the fractions of naphtha and gas oil were determined. The results are shown in Table 13.

TABLE 13

| Fractions (wt. %) of liquid products. Example 11 | | | | | |
|---|---|---|---|---|---|
| Ratio mass of catalyst: mass of heavy oil | Light Naptha (100° C.) | Heavy Naptha (100-200° C.) | Kerosine (200-250° C.) | Gas oil (250-350° C.) | Residual Oil (>350° C.) |
| 1:1 | 19.6 | 72.8 | 2.4 | 4.6 | — |
| 0.75:1 | 19.1 | 66.8 | 3.2 | 9.5 | 0.8 |
| 0.25:1 | 16.3 | 66.8 | 3.5 | 11.2 | 1.2 |

Example 13

Raw material was subjected to pyrolysis process under the same conditions as that in Example 1, except that duration of heat treatment was 3 hours and the raw material was polyethylene.

As apparent from this process, polyethylene cannot be decomposed to heavy oil at temperatures below 375° C. and was residually decomposed. However, 20 g of the residually decomposed polyethylene was loaded inside the reactor with a dolomite catalyst. The catalyst used in Example 13 was prepared in the same proportions and in the same manner as in Example 2. The catalytic cracking reaction procedure of Example 13 was the same as in Example 2. The cracking was carried out at a reaction temperature of 370° C. for 2 hours. The obtained liquid oil yield was 20.2% by wt. of the starting material used. The results are shown in Table 14.

Distillation gas chromatography according to ASTM D 2887 was conducted to the liquid products obtained in Example 13. From the GC, the fractions of naphtha and gas oil were determined. The results are shown in Table 14.

TABLE 14

| Fractions (wt. %) of liquid products. Example 13 | | | | | |
|---|---|---|---|---|---|
| Yield of liquid Cracked oil (% by Weight) | Light Naptha (100° C.) | Heavy Naptha (100-200° C.) | Kerosine (200-250° C.) | Gas oil (250-350° C.) | Residual Oil (>350° C.) |
| 20.2 | 5.8 | 53.8 | 13.6 | 23.1 | 3.1 |

As noticed from Table 14, although the yield of polyethylene cracked oil is not much at low reaction temperatures, the wt. % of naphtha obtained from the catalytic cracking is still high. It can be obtained at a greater yield by increasing the reaction temperatures.

Example 14

In this example, yields of residual oil obtained from pyrolysis of mixed plastics were compared.

Raw materials were subjected to pyrolysis process under the same conditions as those in Example 1, except that duration of heat treatment was 3 hours and the raw materials were 40 g of polystyrene, 10 g of polyethylene and 10 g of polypropylene, a total of 60 g. The obtained liquid oil yield was in the range of 86.2 to 91.1% by wt. of the initial weight of plastic used. The results are shown in Table 15.

TABLE 15

| Yields of the residual oil (% by weight) at 375° C. | | | | | |
|---|---|---|---|---|---|
| Run1 | Run2 | Run3 | Run4 | Run5 | Run6 |
| 90.5 | 86.2 | 89.7 | 89.2 | 91.1 | 87.3 |

Example 15

In this example, yield of cracked oil product by catalytic cracking of plastics-derived liquid from the pyrolysis process was shown. Residual oil obtained from Example 14 was used as a raw material. The catalyst used in Example 15 was prepared in the same proportions and in the same manner as in Example 2. The catalytic cracking reaction procedure of Example 15 was the same as in Example 2, except the reaction temperature was set at 420° C. for 3 hours. The obtained liquid oil yield was 64.1% by wt. of the starting material used. The result is shown in Table 16.

Distillation gas chromatography according to ASTM D 2887 was conducted to the liquid products obtained in Example 15. From the GC, the fractions of naphtha and gas oil were determined. The results are shown in Table 16.

TABLE 16

| Fractions (wt. %) of liquid products. Example 15 | | | | | |
|---|---|---|---|---|---|
| Yield of liquid Cracked oil (% by Weight) | Light Naptha (100° C.) | Heavy Naptha (100-200° C.) | Kerosine (200-250° C.) | Gas oil (250-350° C.) | Residual Oil (>350° C.) |
| 64.1 | 32.3 | 62.1 | 2.3 | 2.7 | — |

What is claimed is:

1. A process for producing fuel from a plastic waste material by using a dolomite catalyst comprising:

(a) performing pyrolysis of the plastic waste material to produce a liquid material for cracking, and (b) mixing said liquid material for cracking with a dolomite catalyst prepared by calcining natural ore dolomite at a temperature of 900° C. or above, and cracking said liquid material at a temperature from about 300° C. to about 500° C. in a reactor by mixing.

2. A process according to claim 1, wherein said plastic waste is at least one of polyethylene, polystyrene or polypropylene.

3. A process according to claim 2, wherein said plastic waste comprises polystyrene.

4. A process according to claim 1, wherein the pyrolysis of the plastic waste material is performed at a temperature from about 300 to 500° C.

5. A process according to claim 4, wherein the pyrolysis of the plastic material is performed at a temperature from about 330 to 400° C.

6. A process according to claim 1, wherein the pyrolysis is performed for about 30 minutes to about 4 hours.

7. A process according to claim 1, wherein said liquid material obtained in the pyrolysis step has a heavy oil content of 80 to 95%.

8. A process according to claim 1, wherein the cracking of the liquid material with the dolomite catalyst is conducted at a temperature from about 300° C. to about 500° C.

9. A process according to claim 1, wherein the duration of the cracking of the liquid material with the dolomite catalyst is from about 30 minutes to about 5 hours.

10. A process according to claim 1, further comprising cooling gas products obtained by cracking said liquid material with a condenser system to fraction into liquid and gas.

11. A process according to claim 10, further comprising fractioning said gas products into light naphtha, heavy naphtha, kerosene, light gas oil, heavy gas oil and gas.

12. A process according to claim 1, wherein said catalyst is prepared by calcining natural ore dolomite at a temperature from about 900° C. to about 1,200° C.

13. A process according to claim 12, wherein the duration of calcination is from 2 hours to about 12 hours.

14. A process according to claim 1, wherein said catalyst is in the oxidized state.

* * * * *